United States Patent [19]

Lassche

[11] 4,214,466

[45] Jul. 29, 1980

[54] APPARATUS FOR THE WINDING OF HELICAL SPRINGS

[75] Inventor: Jakob Lassche, Dunningen, Fed. Rep. of Germany

[73] Assignee: Hugo Kern und Liebers & Co., Schramberg, Fed. Rep. of Germany

[21] Appl. No.: 943,725

[22] Filed: Sep. 19, 1978

[30] Foreign Application Priority Data

Sep. 27, 1977 [DE] Fed. Rep. of Germany ..... 2743309

[51] Int. Cl.[2] ..... B21F 3/04

[52] U.S. Cl. ..... 72/142

[58] Field of Search ..... 72/135, 142, 144, 145, 72/371

[56] References Cited

U.S. PATENT DOCUMENTS 3,468,148 9/1969 Tsurumoto ..... 72/142

FOREIGN PATENT DOCUMENTS 585792 10/1933 Fed. Rep. of Germany ..... 72/142

505279 5/1920 France ..... 72/142

*Primary Examiner*—Ervin M. Combs

*Attorney, Agent, or Firm*—Lackenbach, Lilling & Siegel

[57] ABSTRACT

An apparatus for winding spring wire from a stationary supply spool into a helical or spiral spring. The apparatus is equipped with a rotationally driven winding mandrel having a forward end and being provided with a radial slot at its forward end for the reception of the spring wire. The mandrel is axially movable with the increasing length of a helical or spiral spring, from a withdrawn or forward initial position into a projecting final position. The apparatus further includes a transfer head, having a guide channel, positioned adjacent to the final position of the mandrel and with the guide channel in the transfer head coaxially aligned with the mandrel, for the passage of the spring therethrough. At least one roller compressively biased against the forward end of the mandrel in the final position thereof and is rotatable in a plane passing through the rotational axis of the mandrel; and the transfer head is driven coaxially and synchronously with the mandrel.

10 Claims, 4 Drawing Figures

APPARATUS FOR THE WINDING OF HELICAL SPRINGS

BACKGROUND AND SUMMARY OF THE INVENTION

The invention relates to an apparatus for the winding of helical springs with a rotationally driven winding mandrel, provided with a radial slot at its forward end for the reception of the spring wire, which can be axially dispaced from a withdrawn initial position towards a projecting final position.

In known apparatus of this type—such as described, for example, in U.S. Pat. No. 952,582 and in German Patent No. 585,792—the end of the spring wire is positioned in the radial slot at the forward end of the winding mandrel and, therethrough, clamped to the winding mandrel. The winding mandrel is then powered into rotation and draws the spring wire from the supply coil and winds it spirally on itself. Corresponding to the increased length of the wound wire, or of the spring into which it was wound, the winding mandrel is slid axially out from the machine housing which contains the mandrel drive.

As soon as the mandrel has reached its end position, upon being pushed out to its full extent, the forward end of the wire will be pushed out of the radial slit of the mandrel with the increasing length of the helical spring. The spring is, thereupon, no longer entrained by the rotational movement of the mandrel and the spring winding process is interrupted. Consequently, winding machines of the prior art can only wind springs whose length does not exceed the length of the winding mandrel. Since the length of the winding mandrel is limited by consideration of mechanical stability, the length of the helical springs which may be wound on the known winding machines on a mandrel is also limited.

It is a principle object of the invention, therefore, to provide apparatus for the winding of helical springs, wherein the length of the spring which may be wound thereon is not limited by the length of the mandrel, so that helical springs of any desired length may be wound.

This and other objects are attained by a device of the type described in the introductory paragraph, through the provision of a transfer head adjacent to the final position of the mandrel, with a guide channel passing through the transfer head in coaxial alignment with the mandrel, for the passage of the wound spring therethrough, and wherein at least one roller, radially pressed against the forward end of the mandrel when it is in its final position, is provided on the transfer head, and wherein the transfer head is rotationally driven together with the mandrel, and synchronously therewith.

The apparatus of the invention permits the windings of helical springs of any desired length in the following manner.

Initially, as with a spring winding machine of the prior art, the end of the spring wire is located in the radial slot at the forward end of the mandrel. The mandrel is set into motion and draws the spring wire and winds it into a helical spring. The mandrel slides forward with the increasing length of this wound spring, until it had been axially displaced for its full length, into its final position.

Before the mandrel reaches its final position, the forward end of the mandrel slides into the transfer head. The one, or more, rollers on the transfer head are pressed, under load, onto the outer surface of the helically wound spring and press it, in turn, radially against the forward mandrel end portion. As the beginning of the spring wire is pushed from the radial slot of the winding mandrel, upon the continuation of the winding process, the helical spring continues to be entrained by the rotating mandrel since the rollers lock the spring radially inward against the mandrel.

Since the rollers are, themselves, rotationally free, and since the entire transfer head is rotated in synchronism with the winding mandrel, the rollers lock the helical spring against the mandrel but do not impede the forward displacement of the spring axially along the mandrel. The spring may, therefore, be further wound into any desired length; with the wound spring exiting through the guide channel of the transfer head.

So as to ensure that the rollers can press the helical spring against the mandrel with a high load, and yet not impede the axial forward travel of the spiral spring with respect to the mandrel, it is important that the spring should be able to set the rollers into rotational motion despite the high compression load. For this purpose it is advantageous to provide teeth on the periphery of the rollers, with the spacing of the teeth corresponding to the lead of the spring coils. The teeth, therefore, enter always between the individual spring coils, so that the rollers can be easily rotated even with a negligible axial forward pressure of the wound spring.

Furthermore, the unhindered forward movement of the helical spring is favored, despite the high compression loads of the rollers, by a conical development of the mandrel.

Even a small taper of the mandrel results in a material improvement of the ease of forward translation of the helical spring.

The entrainment of the wound helical spring on the rotating mandrel is further assisted by the inherent tendency of the helical spring to lock itself automatically under a torsional load against the mandrel. Initially the spring is only held by its forward end against the mandrel by the rollers and rotated along with the mandrel. At the rearward end of the mandrel, where the spring wire is led onto the mandrel an opposing tension is imposed on the wire, since the wire must be pulled off the supply coil by the rotation of the mandrel. In this manner, the helical spring is placed under a torsional load over its entire length along the mandrel. This torsion results in a reduction in the cross-sectional diameter of the helical spring and, consequently, in a locking of the spring against the tapered outer surface of the mandrel along its entire length. This self-induced locking of the spring on the full length of the mandrel makes possible the transfer of the entire torque of the winding mandrel onto the wire being drawn from its supply coil with a relatively negligible clamping load exerted by the rollers of the transfer head.

The apparatus of the invention permits the manufacture of helical coil springs of any desired length. Therefore, the length of the spring which may be made is no longer restricted by the length of the winding mandrel. The apparatus of the invention may be utilized advantageously even for the manufacture of shorter helical springs, since the shorter spring lengths may be severed from each other in a working step subsequent to the manufacture of a continuous, elongated spring coil. In this manner non-productive standstill periods of the winding machine may be obviated.

The apparatus of the invention may also be used to advantage in the manufacture of helical springs with a preload. The severance of shorter springs from a continuous spring coil has, in this case, the additional advantage that the wound-in preload is available to the very ends of the cut-off spring lengths.

BRIEF DESCRIPTION OF THE DRAWINGS

The invention is more fully described, below, in a particular embodiment, with reference to the enclosed drawings, wherein.

DESCRIPTION OF THE PREFERRED EMBODIMENTS

Figure 1:
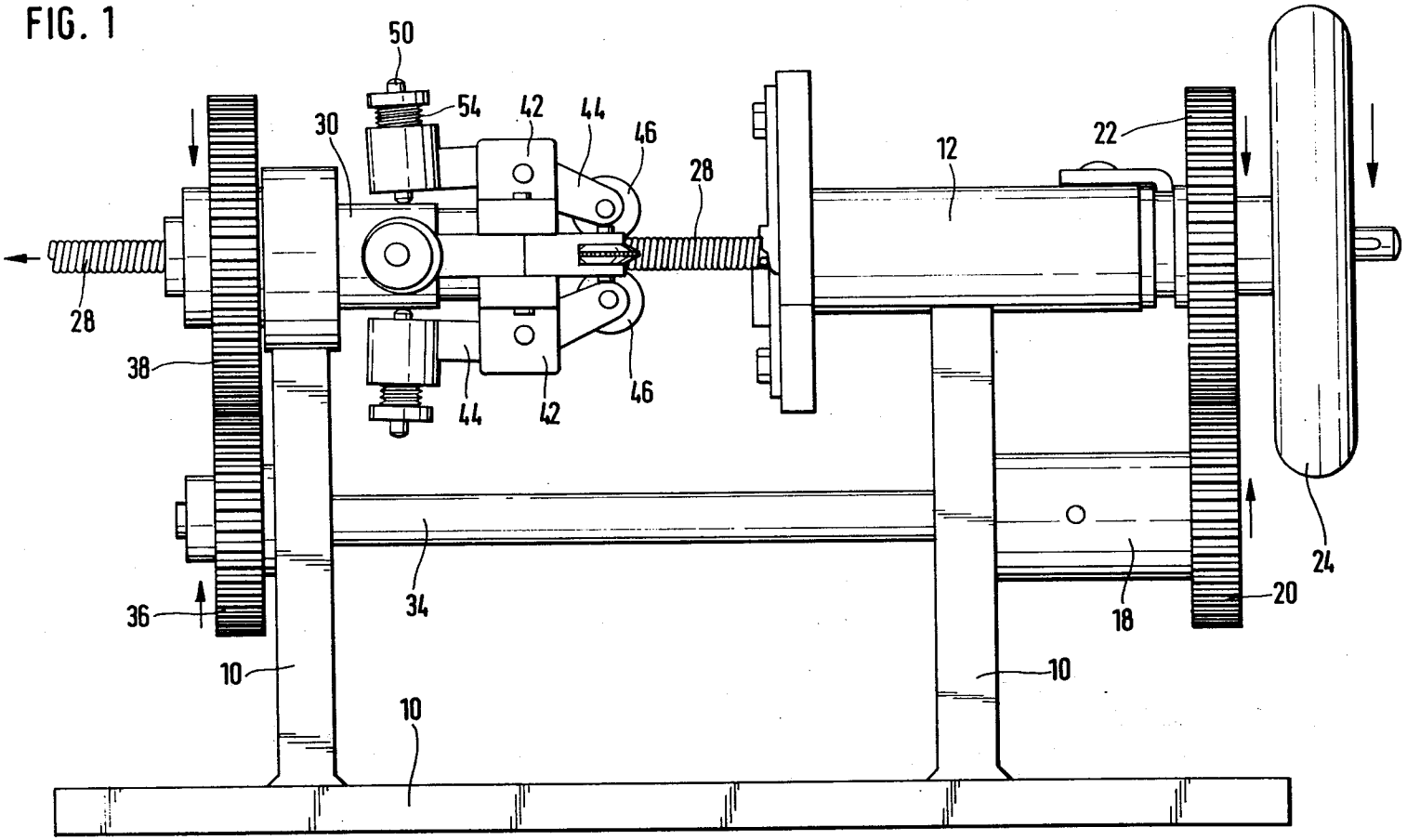
FIG. 1 shows, in a side elevational view, an apparatus of the invention for the winding of helical springs.

The apparatus comprises a machine frame 10, which supports a housing 12 wherein a winding mandrel 14 is journalled. The winding mandrel 14 is journalled to the housing 12 by means of a slide sleeve 16, so that it may be rotated around its longitudinal axis, on the one hand, and can also be pushed out of the housing 12, on the other hand. A drive motor 18 sets the slide sleeve 16, and the mandrel 14 therewith, into rotary motion through gears 20 and 22. A handwheel 24 allows the manual rotation of mandrel 14.

At the forward end of the mandrel, projecting from the housing 12, the mandrel is provided with a radial slot 26. This radial slot 26 serves to locate the forward end of the spring wire at the beginning of the winding process, so that wire is entrained through the rotation of the mandrel 14.

The apparatus described above corresponds to a winding machine of the prior art, and the working process also corresponds to that of a known winding machine.

At the beginning of the working cycle the mandrel 14 is in a completely withdrawn initial position within the housing 12. Only the receiver portion, formed by the radial slot 26, projects from the housing. The spring wire, taken off a supply coil, is positioned in the radial slot 26 and a few rotations of the mandrel 14 by the handwheel 24 ensure that the wire is rigidly held on the mandrel 14.

Figure 2:
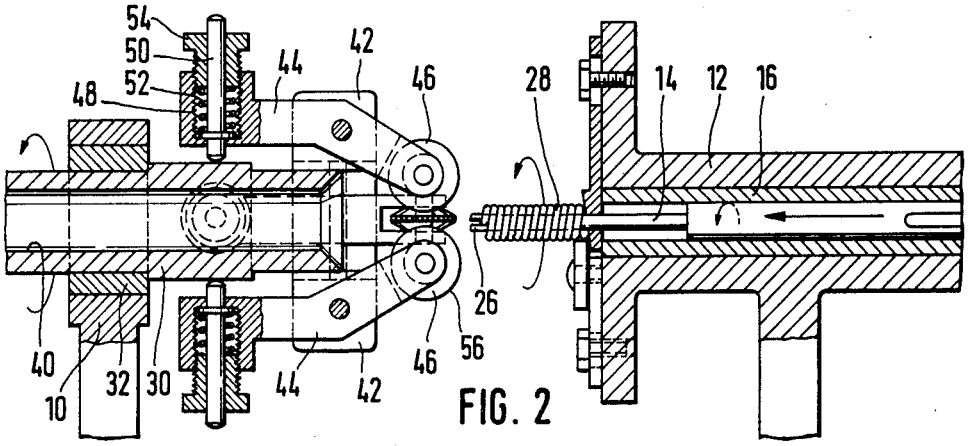
FIG. 2 shows a longitudinal sectional view of this apparatus in a position prior to the entry of the mandrel into the transfer head.

Now, the mandrel 14 is set into rotation through the motor 18, whereby the spring wire is drawn by the mandrel 14 and wound into a helical spring 28 thereon. As the length of this helical spring 28 wound onto the mandrel increases, the mandrel 14 slides axially out of the housing 12, as shown in FIG. 2.

As soon as the mandrel reaches its final position, fully pushed outward from the housing 12, the helical spring 28 which increases in length through the continued rotation of the mandrel 14 slips off the mandrel forwardly, wherethrough the forward end of the spring wire is disengaged from the radial slot 26. In a winding machine of the prior art, the rotating mandrel can no longer entrain the helical spring 28, so that the winding cycle is interrupted. In accordance with the invention and in contradistinction thereto, the helical spring is taken up by a transfer head 30, prior to the mandrel 14 reaching its forward final position. The transfer head 30 is rotatably journalled within the machine frame 10 by means of a bearing 32. Through a shaft 34 and geared wheels 36 and 38 the transfer head 30 is driven synchronously with mandrel 14 by the motor 18.

The transfer head 30 is provided with an internal guide channel 40, passing axially therethrough. The guide channel 40 runs coaxially with mandrel 14 and in continuation thereof; the rotational movement of the transfer head 30 is centered on the centerline of this guide channel 40.

The face of the transfer head 30 opposite the mandrel 14, and, consequently, the entrance opening of the guide channel 40 are offset with a small space from the forward end of the mandrel 14, when the latter is in its forwardly final position.

Around the circumference of this face of the transfer head 30, opposite the mandrel 14, four stirrups 42 project outwardly, spaced always at 90° from each other. Between the tines of these stirrups 42 there is provided in each case a centrally pivoted lever 44.

A rotatable roller 46 is journalled at the forward end, facing the forward end of mandrel 14, of each of the levers 44 in stirrups 42. The rollers each rotate in a plane encompassing the central axes of the mandrel 14 and of the transfer head 30.

The second arm of each lever 44, facing away from the mandrel 14, is provided with an orifice 48 running substantially radially towards the transfer head 30; these orifices are reduced in diameter by means of a inwardly projecting flange nearest the transfer head 30. A pin 50 is located in each orifice 38, surrounded by a compression spring 52. The compression springs 52 bear against collars on the pins 50, which, in order to restrict the longitudinal travel of the pins 50 in the orifices 38, come into contact with the aforementioned inward flanges. At its other end each compression spring 52 bears against a threaded cup 54 which may be screwed into the end of the orifice 38 facing away from the transfer head 30, and receives the end of the pin 50 in a central orifice therein in an axially reciprocable manner.

The rollers 46 are provided at their peripheries with suitable gearing 56. The shape of the gear teeth and their spacing corresponds to the diameter of the spring wire and the coil spacing of the helical spring 28. The base of the gearing can, consequently, accurately grip the curvature of the wire coils of the spring 28.

Figure 3:
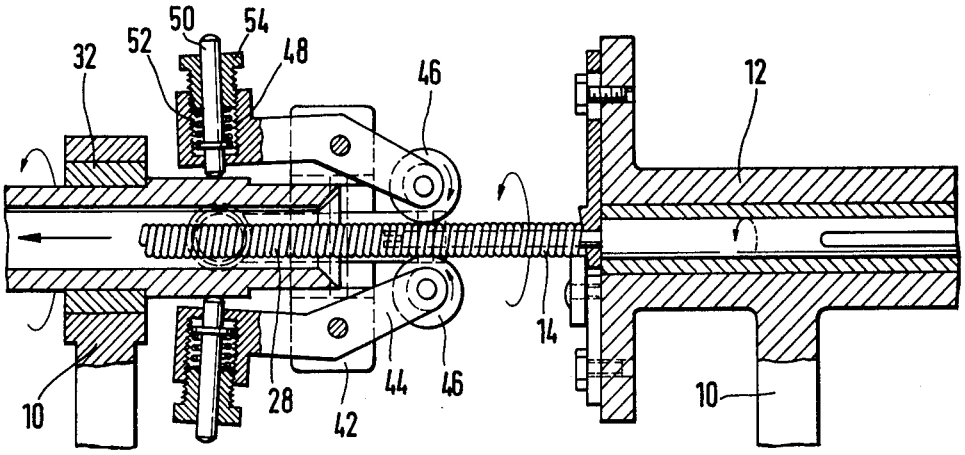
FIG. 3 shows a longitudinal sectional view in a position in which the wound helical spring has been taken over by the transfer head.
Figure 4:
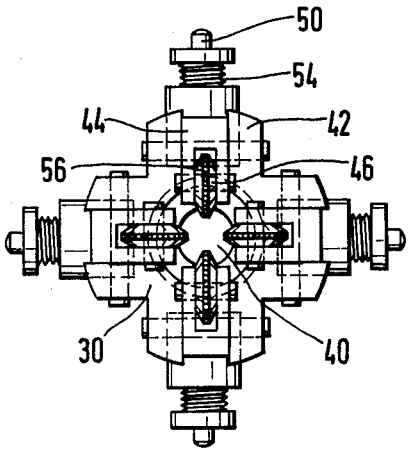
FIG. 4 shows a frontal view of the transfer head of this apparatus.

The rollers 46 are positioned in front of the end of the transfer head 30 opposite the mandrel 14, so that they ride over the forward end of the mandrel, when the latter is in its forward limit position, and bear on the outer surface of the mandrel, as best shown in FIG. 3. The mandrel is constructed with a slight, continuous conical taper.

Before the mandrel 14 attains, in the previously described working cycle, its forward limit position, completely displaced out of the housing 12, as shown in FIG. 3, the conical mandrel slides, with the helical spring 28 coiled thereon, in between the four rollers 46. The rollers engage the mandrel, thereupon, and lie against the outside of the helical spring 28.

This causes the rollers 46 to be displaced outwardly and the levers 44 to be pivoted. As may be seen by comparing FIGS. 2 and 3, this pivotal movement of the levers 44 results in a sliding displacement of the pins 50, which bear against the outer surface of the transfer head 30, against the compression load of springs 52, axially disposed in the orifices 48. The compression load of springs 52 results, therefore, in a situation where the rollers 46 are forcibly pressed against the helical spring 28. The magnitude of this compressive force is adjustable by means of threaded cups 54.

The rollers 46 press the helical spring 28 radially inward against the forward end of the mandrel 14 and, consequently, prevent a rotation of the spring 28 with respect to this forward end portion of the mandrel. An axial displacement of the helical spring 28 with respect to the mandrel 14 is not, however, prevented by the rollers 46, since the rollers are freely rotatable along the axial direction and, furthermore, the mandrel becomes smaller in diameter through its taper.

The locking of the helical spring 28 at its forward end against the mandrel 14 results, in conjunction with the previously described self-clamping action of the helical spring 28 due to the torsional load placed thereon, in an entrainment of the helical spring 28 by the mandrel 14 even with the beginning of the spring wire pushed out of engagement with the radial slot 26 of the mandrel 14.

The spring coil 28 can, consequently, be further wound, beyond the length of the mandrel 14 and travels through the guide channel 40, as shown in FIG. 3. The spring coil 28 exiting from the discharge end of the guide channel 40, furthest from the mandrel, can be severed into helical spring segments of any desirable length by means of a spring cutting device, located adjacent to the winding machine, without requiring an interruption of the winding process.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

I claim:

1. An apparatus for the winding of spring wire from a stationary supply spool into a helical or spiral spring, said apparatus comprising a rotationally driven winding mandrel having a forward end and being provided with a radial slot at its forward end for receiving and securing therein an end of the spring wire to be wound, said mandrel being axially movable, with the increasing length of a helical or spiral spring, being wound thereon, from a withdrawn or forward initial position into a projecting final position; and means for withdrawing said spring from the forward end of said mandrel in its projecting final position comprising: a transfer head, having a guide channel, positioned adjacent to the final position of the mandrel, said guide channel in the transfer head being in coaxial alignment with the mandrel for receiving the wound spring being withdrawn from said forward end of said mandrel for the passage of the spring therethrough; and at least one roller biased against the forward end of said mandrel and the end of the wound spring thereon in the final position of said mandrel for removing the wound spring from the mandrel, said one roller being rotatable in a plane passing through the rotational axis of said mandrel, and said one roller and said transfer head are mounted for rotation coaxially and synchronously with said mandrel whereby a spring of any desired length can be wound regardless of the length of said mandrel.

2. The apparatus of claim 1, wherein the transfer head (30) is provided with a plurality of rollers, equally spaced in angular relationship with respect to one-another.

3. Apparatus according to claims 1 or 2, wherein the circumference of the rollers is provided with gear-teeth corresponding to the coil spacing of the wound spring.

4. Apparatus according to claims 1 or 2, wherein the circumference of the rollers is provided with frictional gripping means.

5. Apparatus according to claim 1, wherein the Mandrel is tapered.

6. Apparatus according to claim 2, wherein said rollers are arcuately moveable with respect to the transfer head on spring-biased levers.

7. Apparatus according to claim 6, wherein said levers are compound levers with a roller journalled at one end and with the other end supported under an adjustable spring bias, against the transfer head.

8. Apparatus according to claim 1, wherein said transfer head is driven through a transmission by a prime mover driving said mandrel.

9. Apparatus according to claim 5, wherein said taper is substantially small and said roller is compressively biased.

10. Apparatus according to claim 2, wherein said rollers are radially disposed about said mandrel.

* * * * *